US008733866B2

(12) United States Patent
Chen et al.

(10) Patent No.: US 8,733,866 B2
(45) Date of Patent: May 27, 2014

(54) COMBINATION OF BRACKET AND SLIDE ASSEMBLY

(75) Inventors: Ken-Ching Chen, Kaohsiung (TW); Chien-Li Huang, Kaohsiung (TW); Chun-Chiang Wang, Kaohsiung (TW)

(73) Assignee: King Slide Works Co., Ltd., Kaohsiung (TW)

( * ) Notice: Subject to any disclaimer, the term of this patent is extended or adjusted under 35 U.S.C. 154(b) by 300 days.

(21) Appl. No.: 13/220,986

(22) Filed: Aug. 30, 2011

(65) Prior Publication Data

US 2012/0128278 A1 May 24, 2012

(30) Foreign Application Priority Data

Nov. 18, 2010 (TW) ..... 99139844 A

(51) Int. Cl.
*A47B 88/04* (2006.01)

(52) U.S. Cl.
USPC ..... 312/334.4; 211/26

(58) Field of Classification Search
USPC ..... 312/334.1, 334.4, 334.7, 334.8, 265.1; 211/26, 175, 183, 187, 190, 191; 248/200.1, 220.21, 220.22, 218.4
See application file for complete search history.

(56) References Cited

U.S. PATENT DOCUMENTS

| | | | | |
|---|---|---|---|---|
| 6,230,903 | B1 * | 5/2001 | Abbott | 211/26 |
| 6,726,164 | B1 | 4/2004 | Baiza et al. | |
| 6,854,816 | B2 | 2/2005 | Milligan | |
| 6,863,188 | B2 * | 3/2005 | Besserer et al. | 211/183 |
| 7,350,884 | B2 | 4/2008 | Palker et al. | |
| 2001/0040142 | A1 * | 11/2001 | Haney | 211/183 |
| 2002/0074914 | A1 * | 6/2002 | Shih | 312/334.4 |
| 2003/0205539 | A1 * | 11/2003 | Lauchner et al. | 211/26 |
| 2004/0020874 | A1 * | 2/2004 | Haney | 211/26 |
| 2004/0217073 | A1 * | 11/2004 | Dobler et al. | 211/26 |
| 2006/0157436 | A1 * | 7/2006 | Iwamoto | 211/191 |
| 2008/0036347 | A1 * | 2/2008 | Liang | 312/334.5 |
| 2010/0282932 | A1 * | 11/2010 | Ong et al. | 248/206.5 |

* cited by examiner

*Primary Examiner* — James O Hansen
(74) *Attorney, Agent, or Firm* — Rosenberg, Klein & Lee

(57) ABSTRACT

A combination of bracket and slide assembly includes a bracket and a rail. The bracket has a top portion, a bottom portion, a side portion connected to the top and bottom portions, and a support member fixedly to the side portion. The top portion, the bottom portion and the side portion define a longitudinal path. The support member is located in the longitudinal path. The rail extends through the longitudinal path of the bracket and has a top wall, a bottom wall, and a sidewall connected to the top and the bottom walls. The sidewall has a reinforcement path with a recessed surface, and the reinforcement path is located corresponding to the bracket. A first protrusion and a second protrusion are located on the top and the bottom of the reinforcement path. The support member is slidably connected to the reinforcement path and located corresponding to the first and second protrusions.

10 Claims, 14 Drawing Sheets

COMBINATION OF BRACKET AND SLIDE ASSEMBLY

FIELD OF THE INVENTION

The present invention relates to a bracket and a slide assembly, and more particularly, to a structure that reinforces the connection strength between the bracket and the slide assembly.

BACKGROUND OF THE INVENTION

U.S. Pat. No. 6,726,164 to Baiza discloses a "Mounting bracket having a tapered plunger latch" which comprises a rail 52 and a bracket 54, wherein the bracket 54 has a body 98 and three slots 95 which extend along the longitudinal direction of the body 98 and are secured by extending fasteners 68 through the slots 95 and connected to the rail 52. However, the connection between the bracket 54 and the rail 52 is weak and cannot bear loads.

U.S. Pat. No. 6,854,816 to Milligan discloses a "Three member thin drawer slide" which comprises a bracket 151 slidably connected to an outer member 11 and an intermediate slide member 19 is connected to the outer member 11, and an inner slide member 27 connected to the intermediate slide member 19. The bracket 151 has two flanges 171, 173 which are in contact with the top and bottom of the outer member 11. However, when a load is applied to the inner and intermediate slide members 27, 19, the outer member 11 is also applied by the load, the bracket 151 and the outer member 11 are connected by the connection pin located in the slot at the intermediate portion of the outer member 11, the flanges 171, 173 of the bracket 151 are easily deformed by the pressure from the outer member 11.

Therefore, a reinforcement device for the slide assembly is needed, especially when the outer member and the bracket are made to be narrower.

SUMMARY OF THE INVENTION

The present invention relates to a combination of bracket and slide assembly, and comprises a bracket having a top portion, a bottom portion located corresponding to the top portion, a side portion connected to the top and bottom portions, and a support member fixedly to the side portion. The top portion, the bottom portion and the side portion define a longitudinal path. The support member is located in the longitudinal path and has a first connection portion and a second connection portion, wherein the first and second connection portions are located away from the side portion. A rail extends through the longitudinal path of the bracket and has a top wall, a bottom wall located corresponding to the top wall, and a sidewall connected to the top and the bottom walls. The sidewall has a reinforcement path with a recessed surface. The reinforcement path extends along the longitudinal direction of the rail and located corresponding to the support member of the bracket. A first protrusion and a second protrusion are located on the top and the bottom of the reinforcement path. The top wall of the rail is engaged with the top portion of the bracket. The bottom wall of the rail is engaged with the bottom portion of the bracket. The sidewall of the rail is located corresponding to the side portion of the bracket. The first and second connection portions of the support member are respectively in contact with the first and second protrusions and located in the reinforcement path.

Preferably, the first protrusion is connected to the sidewall of the rail and extends downward and into the reinforcement path. The second protrusion is connected to the sidewall of the rail and extends upward and into the reinforcement path.

Preferably, the side portion of the bracket forms a rib which is located adjacent to the support member and the rib extends into the longitudinal path.

Preferably, the support member has an intermediate portion connected to the first and second connection portions, and multiple connection walls connected between the intermediate portion of the support member and the side portion of the bracket.

Preferably, the support member has an intermediate portion connected to the first and second connection portions. The intermediate portion is fixed to the side portion of the bracket. The first connection portion has a first bent section which is located away from the side portion of the bracket. The second connection portion of the support member has a second bent section which is located corresponding to the first bent section.

Preferably, the support member has an intermediate portion connected to the first and second connection portions. The side portion of the bracket forms a rib which is located corresponding to the intermediate portion of the support member. The intermediate portion is fixed to the rib.

Preferably, the support member has an intermediate portion connected to the first and second connection portions. The side portion of the bracket has an opening located corresponding to the intermediate portion of the support member. The intermediate portion of the support member has a bent fixing section which extends through the opening and is connected to the side portion of the bracket.

Preferably, the side portion of the support member has an opening. A first bent section is connected between the first connection portion of the support member and a wall of a first end of the opening. A second bent section is connected between the second connection portion and a wall of a second end of the opening. The second bent section is located corresponding to the first bent section.

Preferably, the side portion of the support member has a first opening located corresponding to the first connection portion of the support member. A second opening is located corresponding to the second connection portion of the support member. A first bent section is connected between the first connection portion and a wall of the first opening. A second bent section is connected between the second connection portion and a wall of the second opening. The first connection portion extends upward from the first bent section and the second connection portion extends downward from the second bent section.

Preferably, the first protrusion is connected to the recessed surface of the reinforcement path and extends upward. The second protrusion is connected to the recessed surface of the reinforcement path and extends downward. The side portion of the bracket has a first opening which is located corresponding to the first connection portion of the support member, and a second opening which is located corresponding to the second connection portion of the support member. A first bent section is connected between two respective walls of the first connection portion and the first opening. A second bent section is connected between two respective walls of the second connection portion and the second opening. The first connection portion extends downward from the first bent section and the second connection portion extends upward from the second bent section.

Preferably, a connection plate is connected between the first and second protrusion. The connection plate is fixed to the recessed surface of the reinforcement path. The first protrusion is located away from the recessed surface of the reinforcement path and extends upward. The second protrusion is located away from the recessed surface of the reinforcement path and extends downward. The side portion of the bracket has a first opening located corresponding to the first connection portion of the support member, and a second opening located corresponding to the second connection portion of the support member. A first bent section is connected between the first connection portion and a wall of the first opening. A second bent section is connected between the second connection portion and a wall of the second opening. The first connection portion extends downward from the first bent section and the second connection portion extends upward from the second bent section.

The primary object of the present invention is to provide a combination of a bracket and a slide assembly, wherein the structure of the bracket is reinforced regardless of the movement between the bracket and the rail.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
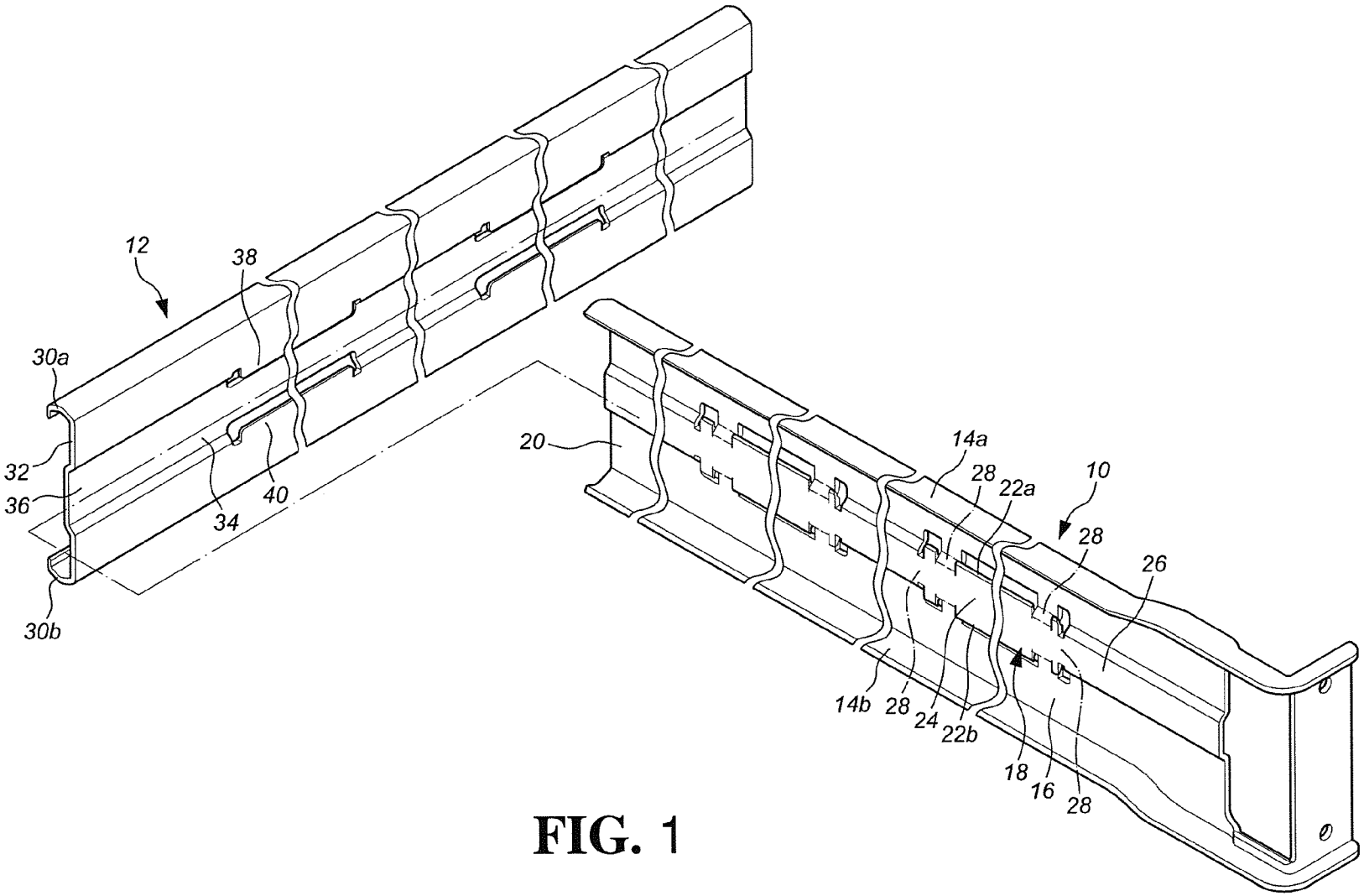
FIG. 1 is an exploded view to show the bracket and the rail of the present invention.
Figure 2A:
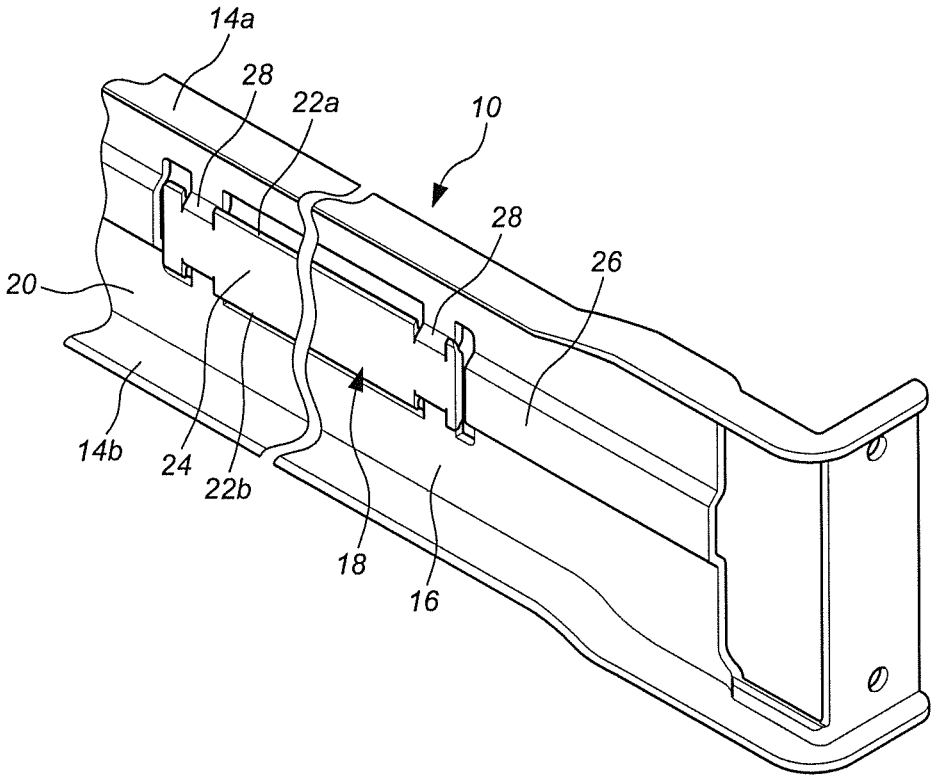
FIG. 2*a* shows the first connection of the first embodiment between the bracket and the support member.
Figure 2B:
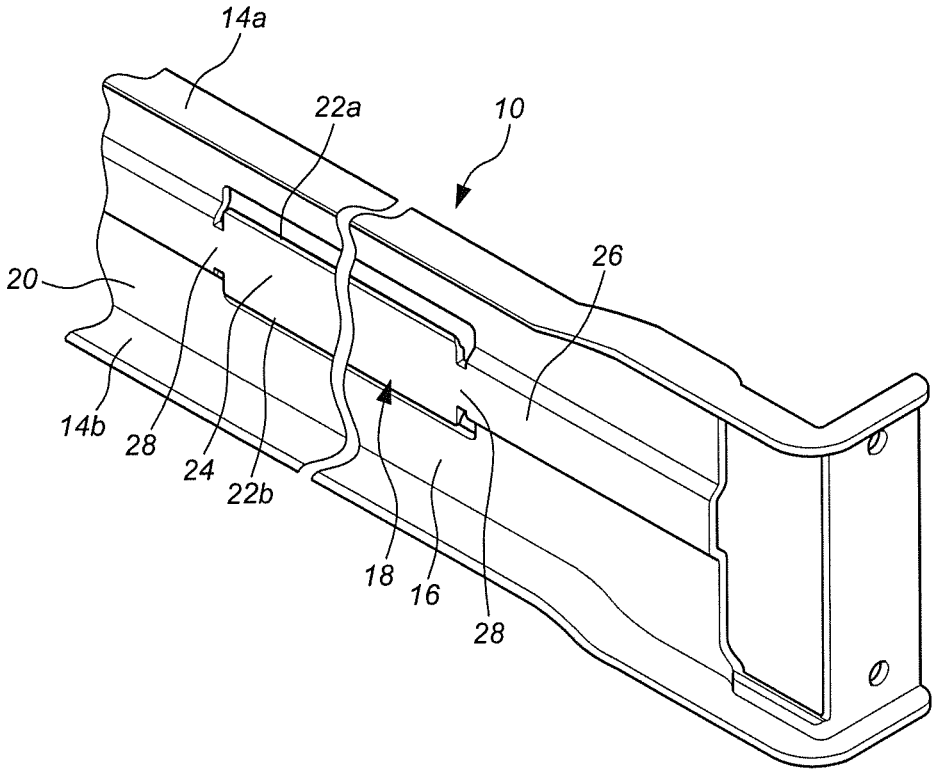
FIG. 2*b* shows the second connection of the first embodiment between the bracket and the support member.
Figure 2C:
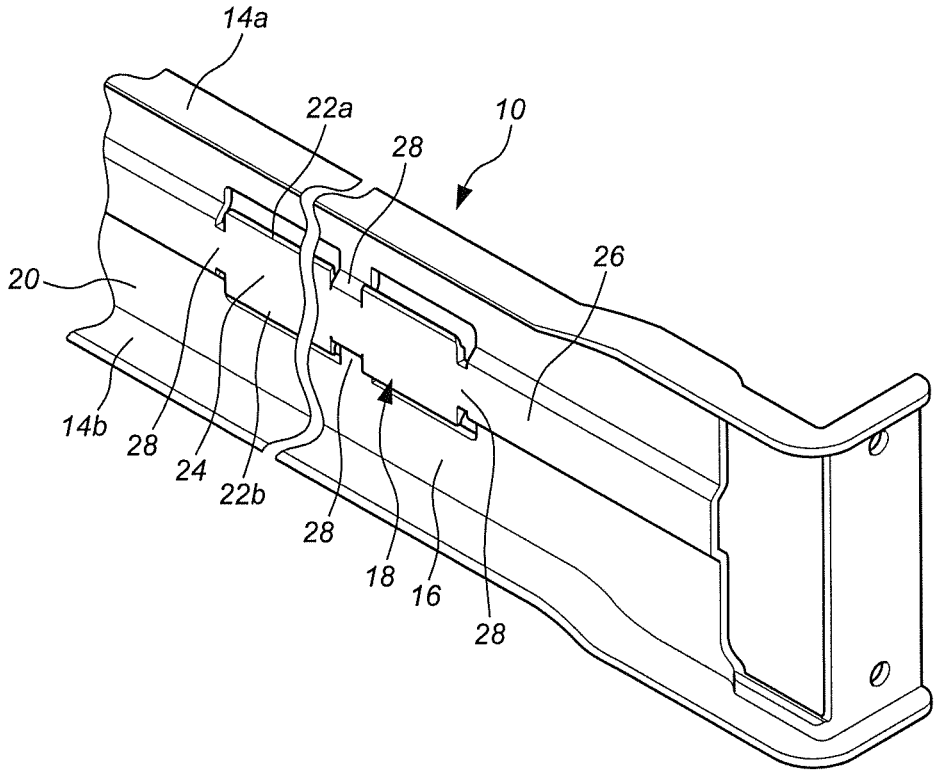
FIG. 2*c* shows the third connection of the first embodiment between the bracket and the support member.

Referring to FIG. 1, the bracket and the slide assembly of the first embodiment of the present invention comprises a bracket 10 and a rail 12, wherein the bracket 10 has a top portion 14*a*, a bottom portion 14*b* located corresponding to the top portion 14*a*, a side portion 16 connected to the top and bottom portions 14*a*, 14*b*, and a support member 18 fixedly to the side portion 16. The top portion 14*a*, the bottom portion 14*b* and the side portion 16 define a longitudinal path 20. The support member 18 is located in the longitudinal path 20 by a means and preferably, by way of pressing. The support member 18 has a first connection portion 22*a* and a second connection portion 22*b*. The support member 18 has an intermediate portion 24 connected to the first and second connection portions 22*a*, 22*b*. The side portion 16 of the bracket 10 forms a rib 26 which is located adjacent to the support member 18 and the rib 26 extends into the longitudinal path 20. Multiple connection walls 28 are connected between the intermediate portion 24 of the support member 18 and the side portion 16 (or the rib 26) of the bracket 10. The arrangement of the connection walls 28 as shown in FIG. 2*a*, the connection walls 28 are arranged in vertical direction and connected between the intermediate portion 24 of the support member 18 and the side portion 16 of the bracket 10. The second arrangement of the connection walls 28 as shown in FIG. 2*b*, the connection walls 28 are arranged in horizontal direction and connected between the intermediate portion 24 of the support member 18 and the rib 26 extended from the side portion 16 of the bracket 10. The arrangement of the connection walls 28 can also be shown in FIG. 2*c* which is a combination of the arrangements in FIGS. 2*a* and 2*b*. Therefore, the first and second connection portions 22*a*, 22*b* are located away from the side portion 16 and a gap is defined between the connection portions 22*a*, 22*b* and the side portion 16.

The rail 12 extends through the longitudinal path 20 of the bracket 10 and has a top wall 30*a*, a bottom wall 30*b* located corresponding to the top wall 30*a*, and a sidewall 32 connected to the top and the bottom walls 30*a*, 30*b*. The sidewall 32 has a reinforcement path 36 with a recessed surface 34. The reinforcement path 36 is located corresponding to the support member 18 of the bracket 10. The reinforcement path 36 extends along the longitudinal direction of the rail 12 and the rail 12 is reinforced by the curved cross section of the reinforcement path 36. The reinforcement path 36 has a first protrusion 38 and a second protrusion 40 located on the top and the bottom of the reinforcement path 36. In detail, the first protrusion 38 is connected to the sidewall 32 of the rail 12 and extends downward and into the reinforcement path 36. The second protrusion 40 is connected to the sidewall 32 of the rail 12 and extends upward and into the reinforcement path 36. Preferably, there are multiple first and second protrusions 38, 40 located along the reinforcement path 36. The first and second protrusions 38, 40 extend from the sidewall 32 by way of pressing.

Figure 3:
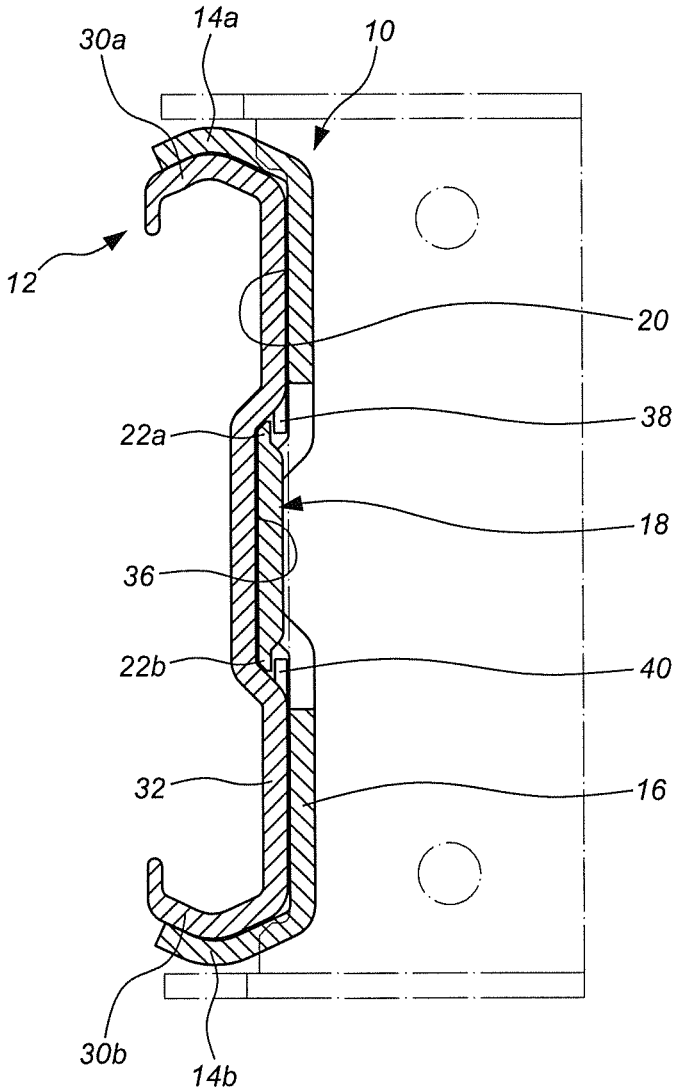
FIG. 3 is a cross sectional view to show the bracket and the rail of the present invention.

As shown in FIG. 3, the rail 12 is located in the longitudinal path 20 of the bracket 10. The top wall 30*a* of the rail 12 is engaged with the top portion 14*a* of the bracket 10, and the bottom wall 30*b* of the rail 12 is engaged with the bottom portion 14*b* of the bracket 10. The sidewall 32 of the rail 12 is located corresponding to the side portion 16 of the bracket 10. The support member 18 of the bracket 10 is located in the reinforcement path 36 of the rail 12, and the first and second connection portions 22*a*, 22*b* of the support member 18 respectively contact the first and second protrusions 38, 40. Therefore, the support member 18 movably extends through the reinforcement path 36. Accordingly, the connection of the bracket 10 and the rail 12, regardless the stationary or movable connection, the structure and anti-bent ability are reinforced.

Figure 4B:
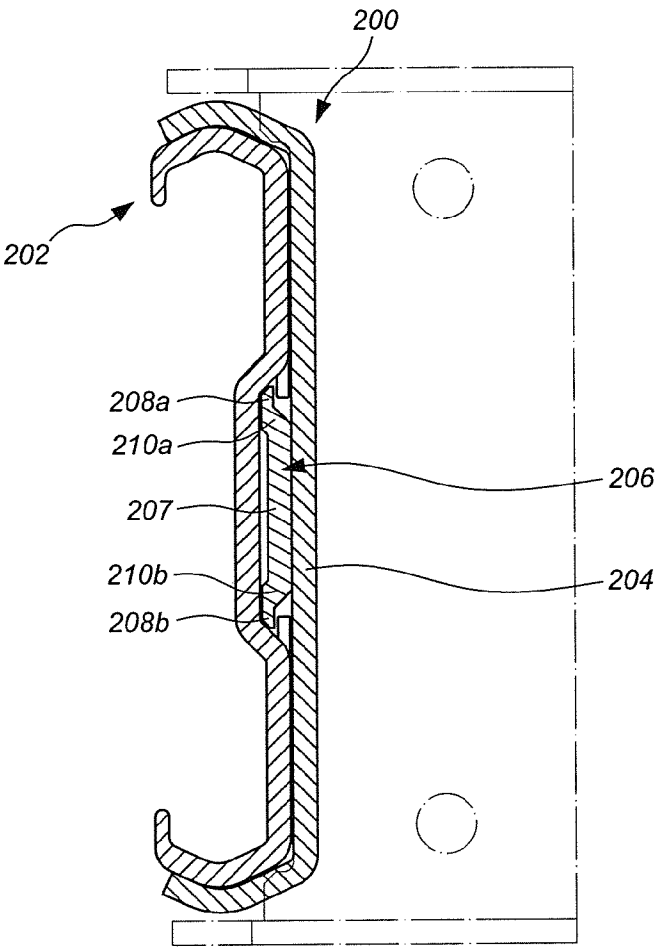
FIG. 4*b* shows the cross sectional view of the second embodiment between the bracket and the rail.
Figure 4A:
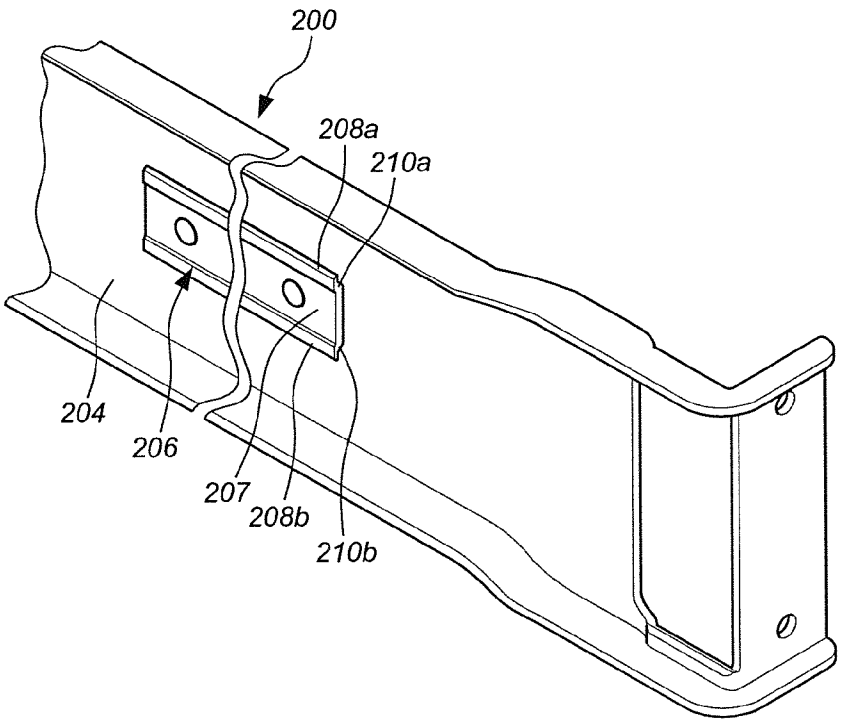
FIG. 4*a* shows the connection of the second embodiment between the bracket and the support member.

As shown in FIGS. 4*a* and 4*b*, the second embodiment comprises a bracket 200 and a rail 202 engaged with the bracket 200. The bracket 200 has a side portion 204. The support member 206 has an intermediate portion 207 connected to the first and second connection portions 208*a*, 208*b*. The intermediate portion 207 is fixed to the side portion 204 of the bracket 200. The first connection portion 208*a* has a first bent section 210*a* which is located away from the side portion 204 of the bracket 200, the second connection portion 208*b* of the support member 206 has a second bent section 210*b* which is located corresponding to the first bent section 210*a*.

Figure 5B:
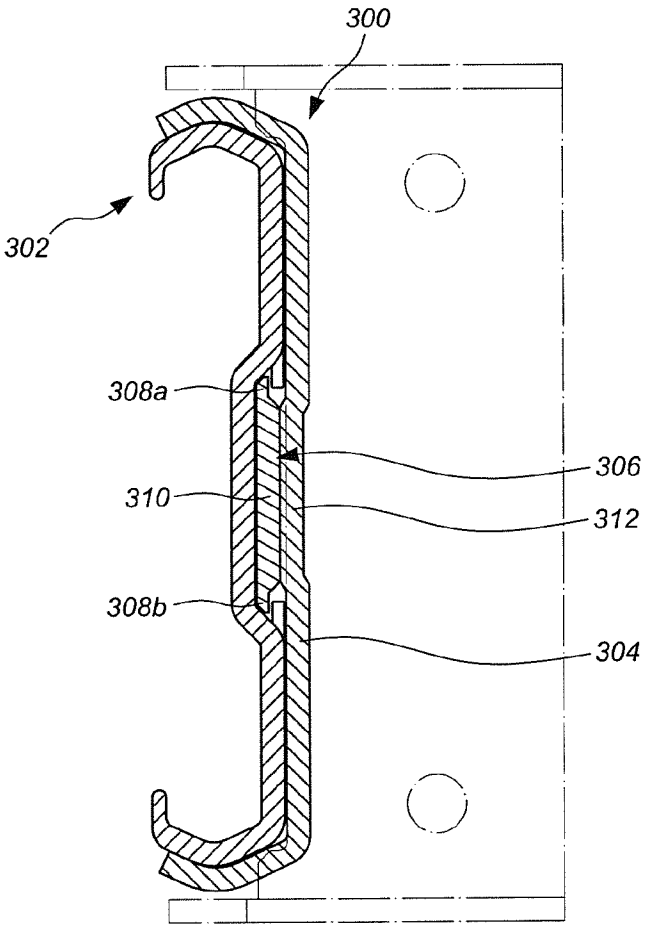
FIG. 5*b* shows the cross sectional view of the third embodiment between the bracket and the rail.
Figure 5A:
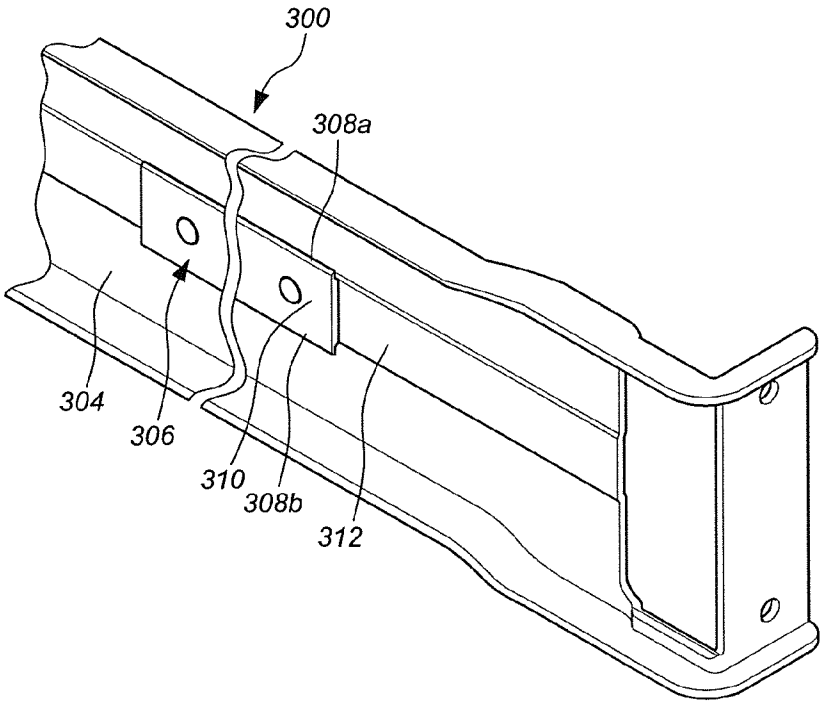
FIG. 5*a* shows the connection of the third embodiment between the bracket and the support member.

As shown in FIGS. 5*a* and 5*b*, the third embodiment comprises a bracket 300 and a rail 302 engaged with the bracket 300. The bracket 300 has a side portion 304. The support member 306 has an intermediate portion 310 connected to the first and second connection portions 308*a*, 308*b*. The side portion 304 of the bracket 300 forms a rib 312 which is located corresponding to the intermediate portion 310 of the support member 306. The intermediate portion 310 is fixed to the rib 312 by way of rivets for example.

Figure 6B:
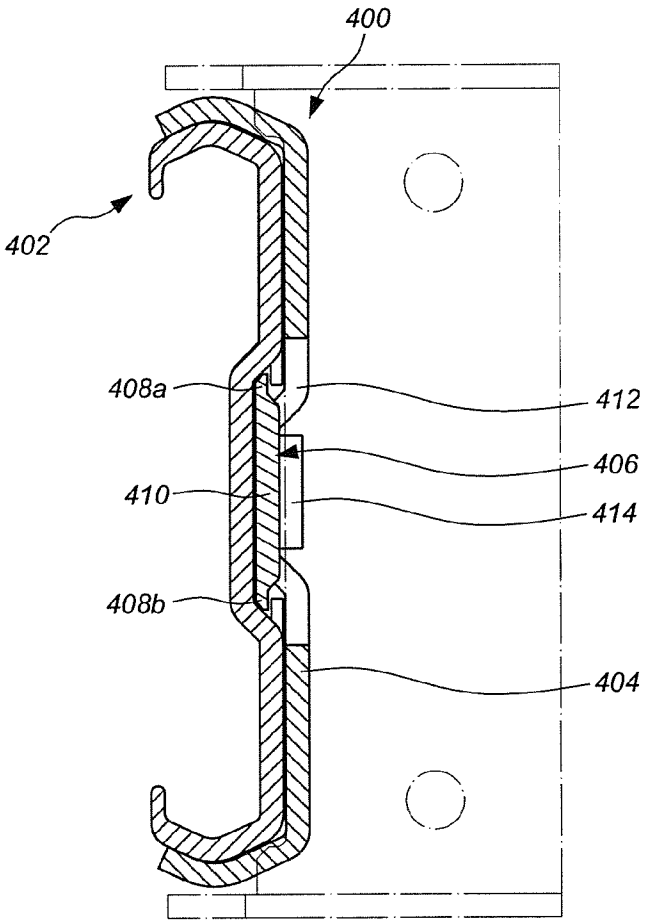
FIG. 6*b* shows the cross sectional view of the fourth embodiment between the bracket and the rail.
Figure 6A:
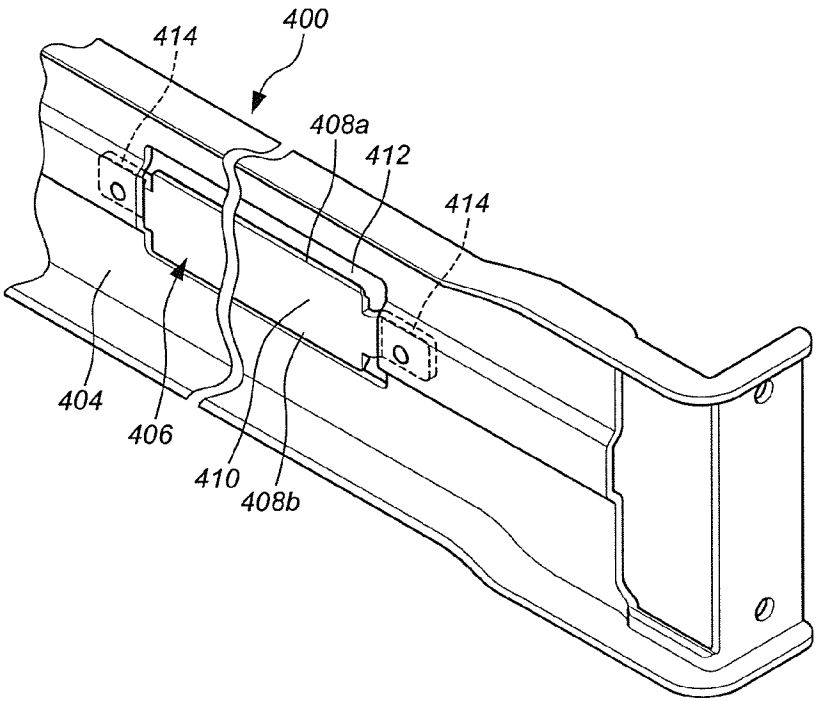
FIG. 6*a* shows the connection of the fourth embodiment between the bracket and the support member.

As shown in FIGS. 6*a* and 6*b*, the fourth embodiment comprises a bracket 400 and a rail 402 engaged with the bracket 400. The bracket 400 has a side portion 404. The support member 406 has an intermediate portion 410 connected to the first and second connection portions 408*a*, 408*b*. The side portion 404 of the bracket 400 has an opening 412 located corresponding to the intermediate portion 410 of the support member 406. The intermediate portion 410 of the support member 406 has a bent fixing section 414 which extends through the opening 412 and is connected to the side portion 404 of the bracket 400 by way of rivets for example.

Figure 7B:
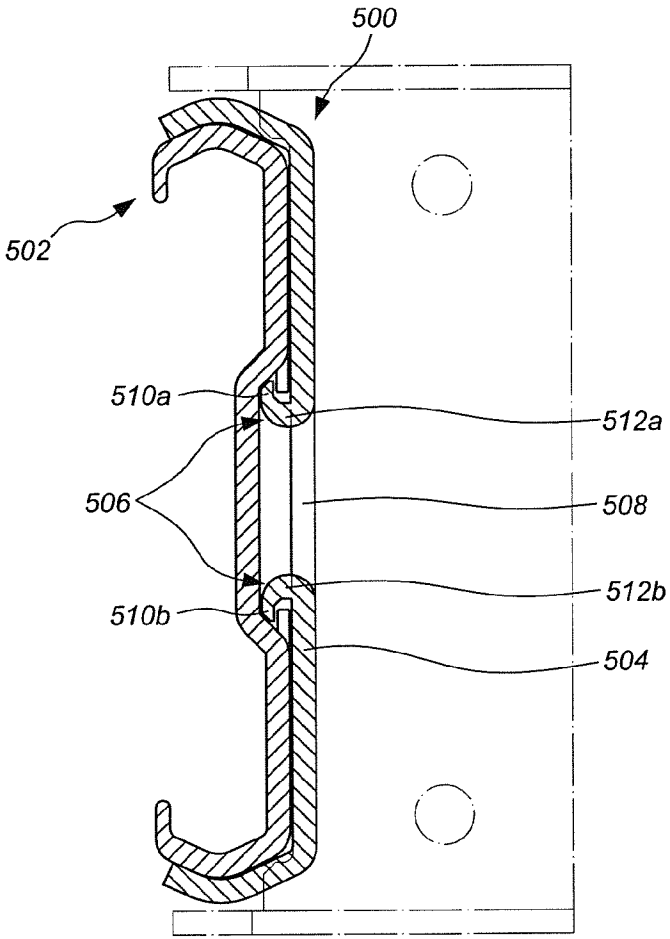
FIG. 7*b* shows the cross sectional view of the fifth embodiment between the bracket and the rail.
Figure 7A:
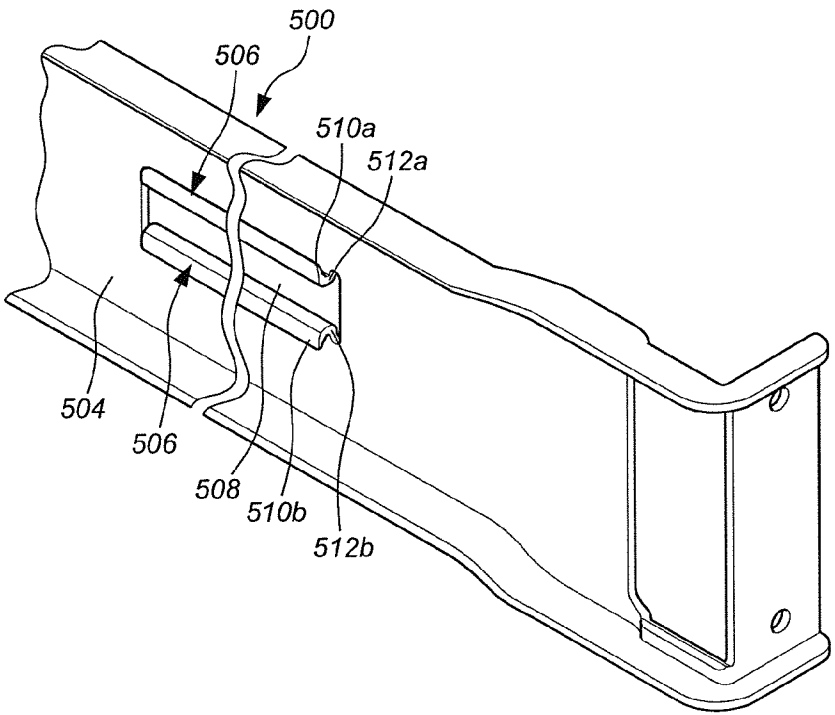
FIG. 7*a* shows the connection of the fifth embodiment between the bracket and the support member.

As shown in FIGS. 7*a* and 7*b*, the fifth embodiment comprises a bracket 500 and a rail 502 engaged with the bracket 500. The bracket 500 has a side portion 504. The side portion 504 of the support member 500 has an opening 508. A first bent section 512*a* is connected between the first connection portion 510*a* of the support member 506 and the wall of the first end of the opening 508. A second bent section 512*b* is connected between the second connection portion 510*b* of the support member 506 and the wall of the second end of the opening 508. The second bent section 512*b* is located corresponding to the first bent section 512*a*.

Figure 8B:
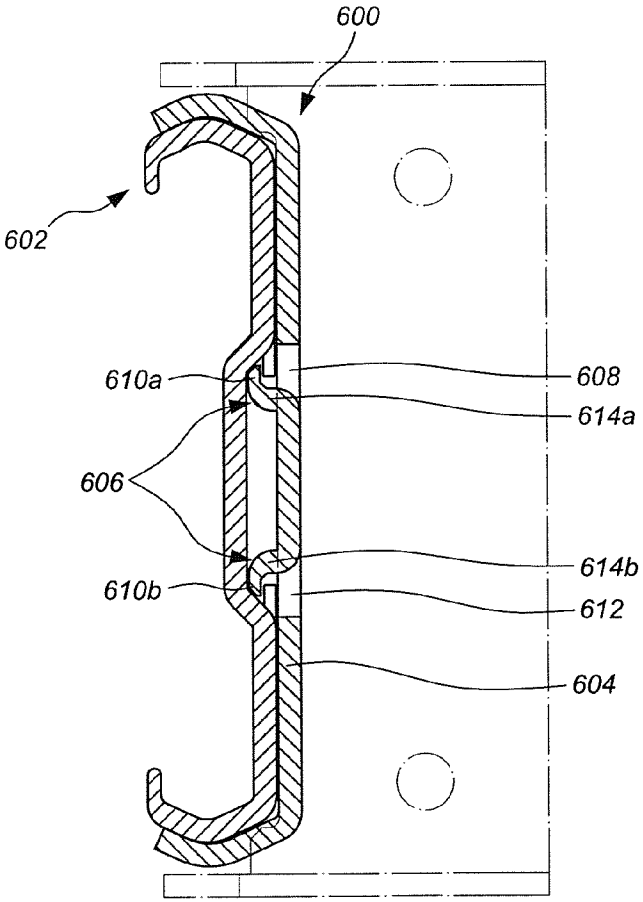
FIG. 8*b* shows the cross sectional view of the sixth embodiment between the bracket and the support member.
Figure 8A:
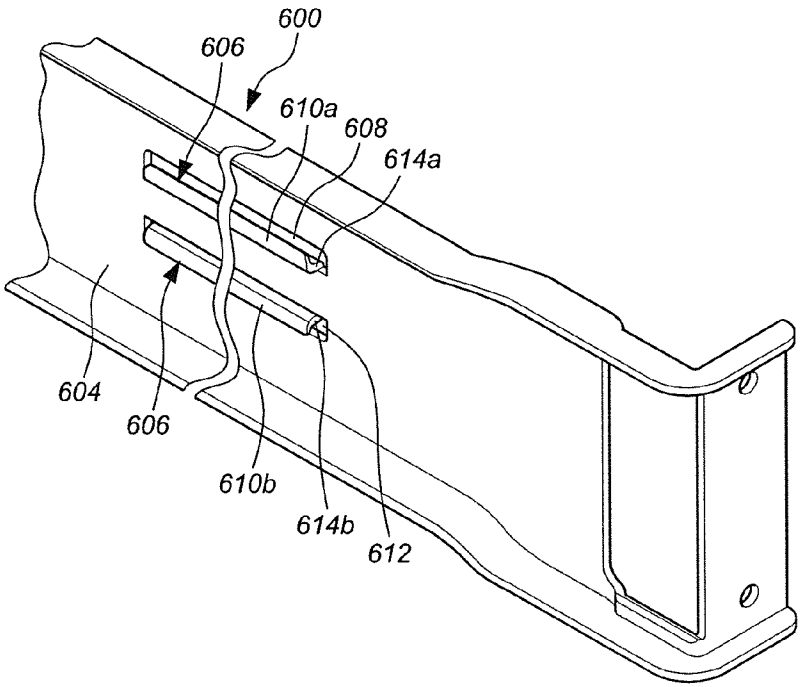
FIG. 8*a* shows the connection view of the sixth embodiment between the bracket and the support member.

As shown in FIGS. 8*a* and 8*b*, the sixth embodiment comprises a bracket 600 and a rail 602 engaged with the bracket 600. The bracket 600 has a side portion 604. The side portion 604 of the support member 600 has a first opening 608 located corresponding to the first connection portion 610*a* of the support member 606, a second opening 612 located corresponding to the second connection portion 610*b* of the support member 606. A first bent section 614*a* is connected between the first connection portion 610*a* and the wall of the first opening 608. A second bent section 614*b* is connected between the second connection portion 610*b* and the wall of the second opening 612. The first connection portion 610*a* extends upward from the first bent section 614*a* and the second connection portion 610*b* extends downward from the second bent section 614*b*.

Figure 9A:
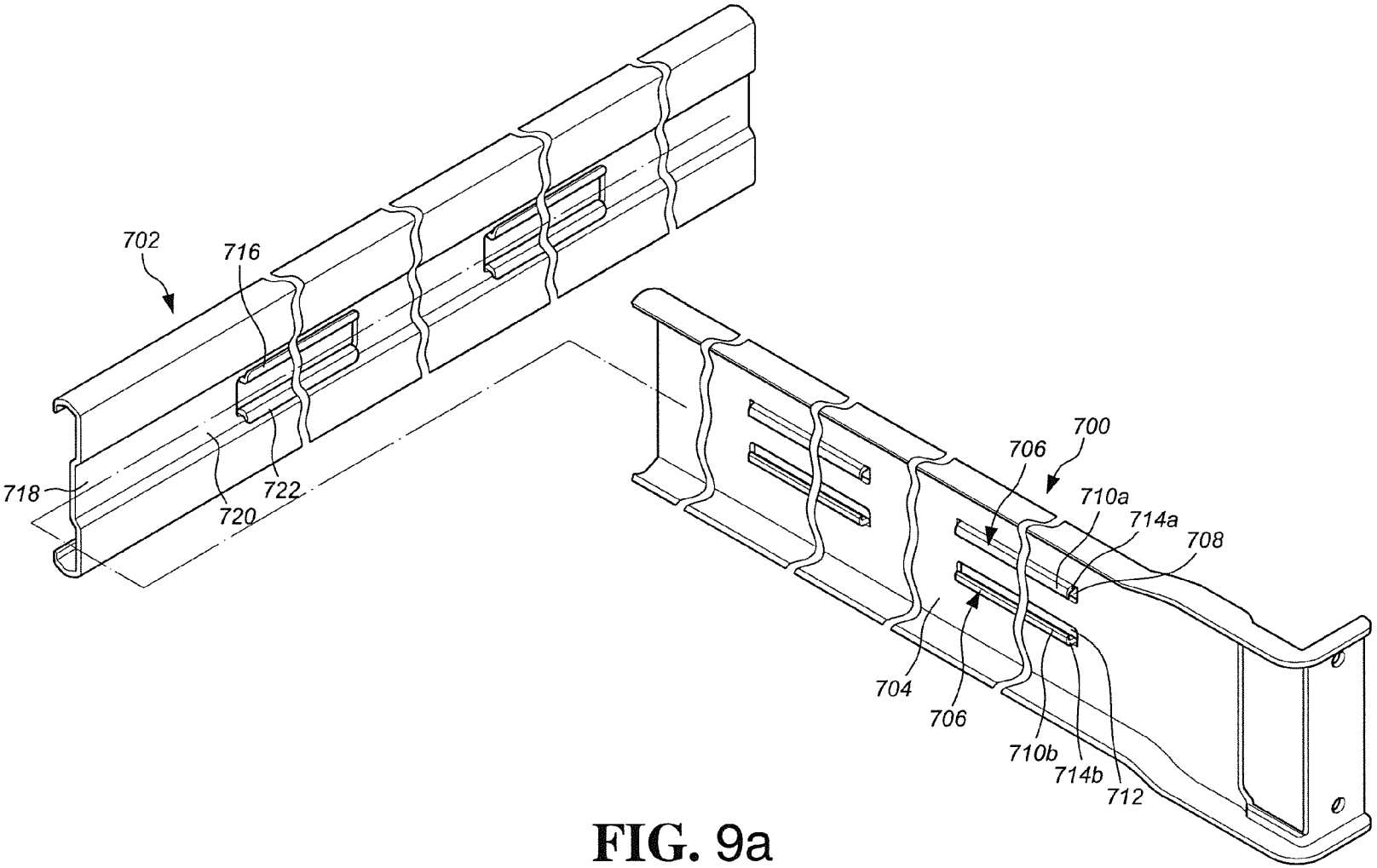
FIG. 9*a* shows the connection of the seventh embodiment between the bracket and the rail.
Figure 9B:
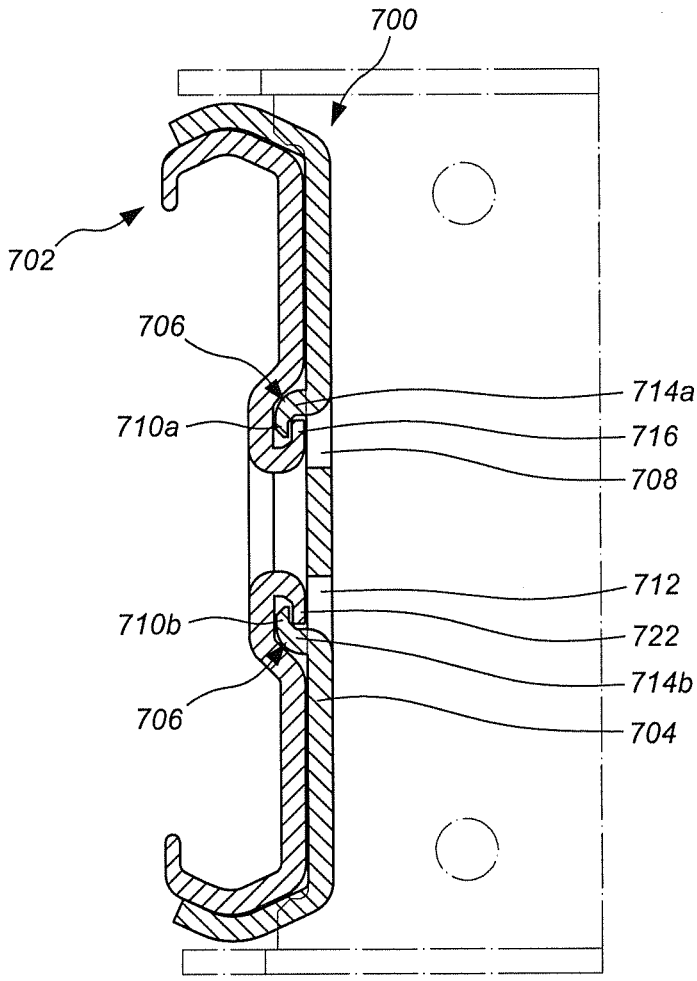
FIG. 9*b* shows the cross sectional view of the seventh embodiment between the bracket and the rail.

As shown in FIGS. 9*a* and 9*b*, the seventh embodiment comprises a bracket 700 and a rail 702 engaged with the bracket 700. The bracket 700 has a side portion 704. The side portion 704 of the bracket 700 has a first opening 708 which is located corresponding to the first connection portion 710*a* of the support member 706, and a second opening 712 which is located corresponding to the second connection portion 710*b* of the support member 706. A first bent section 714*a* is connected between two respective walls of the first connection portion 710*a* and the first opening 708. A second bent section 714*b* is connected between two respective walls of the second connection portion 710*b* and the second opening 712. The first protrusion 716 is connected to the recessed surface 720 of the reinforcement path 718 and extends upward. The second protrusion 722 is connected to the recessed surface 720 of the reinforcement path 718 and extends downward. The first connection portion 710*a* extends downward from the first bent section 714*a* and the second connection portion 710*b* extends upward from the second bent section 714*b*.

Figure 10A:
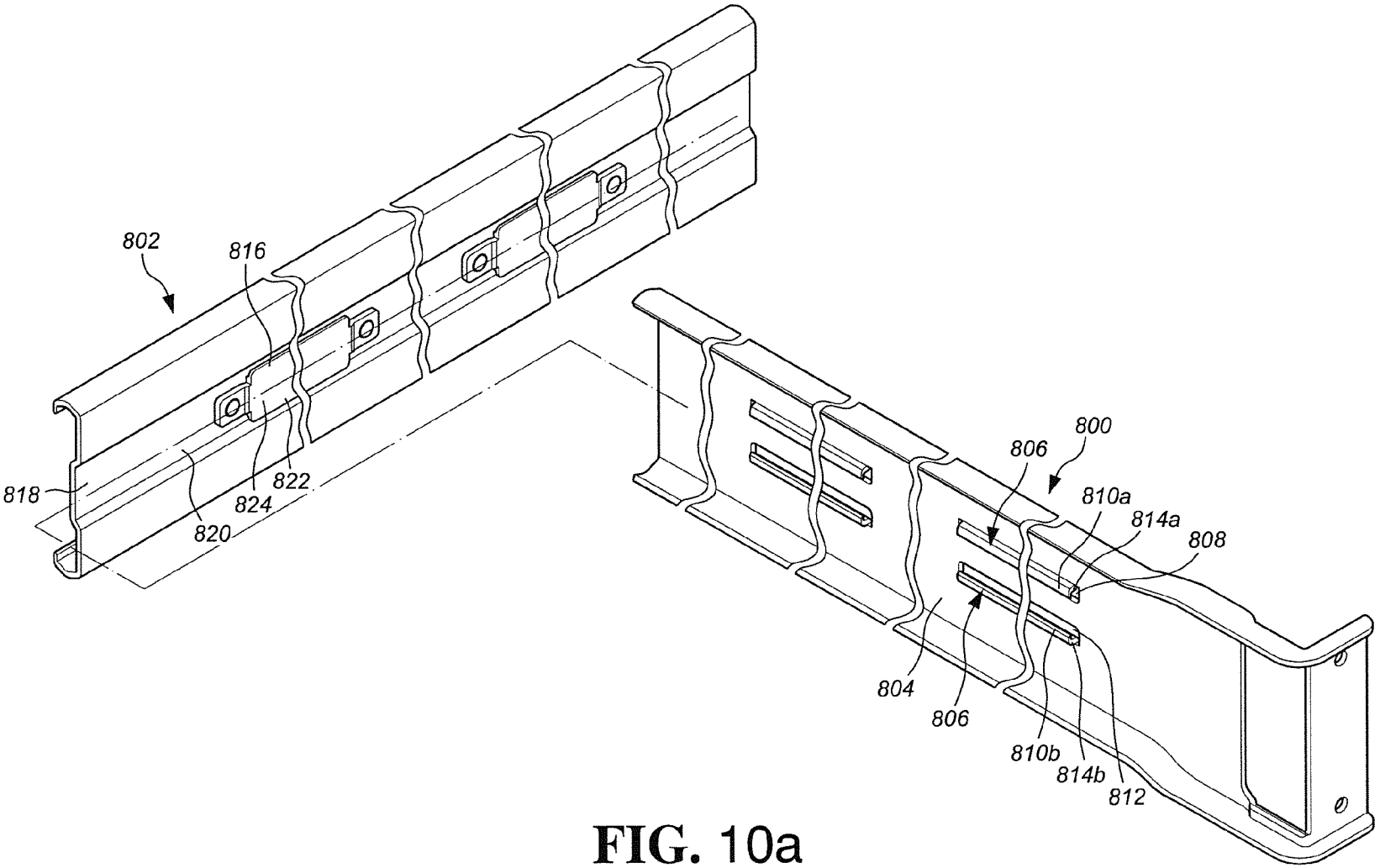
FIG. 10*a* shows the connection of the eighth embodiment between the bracket and the rail.
Figure 10B:
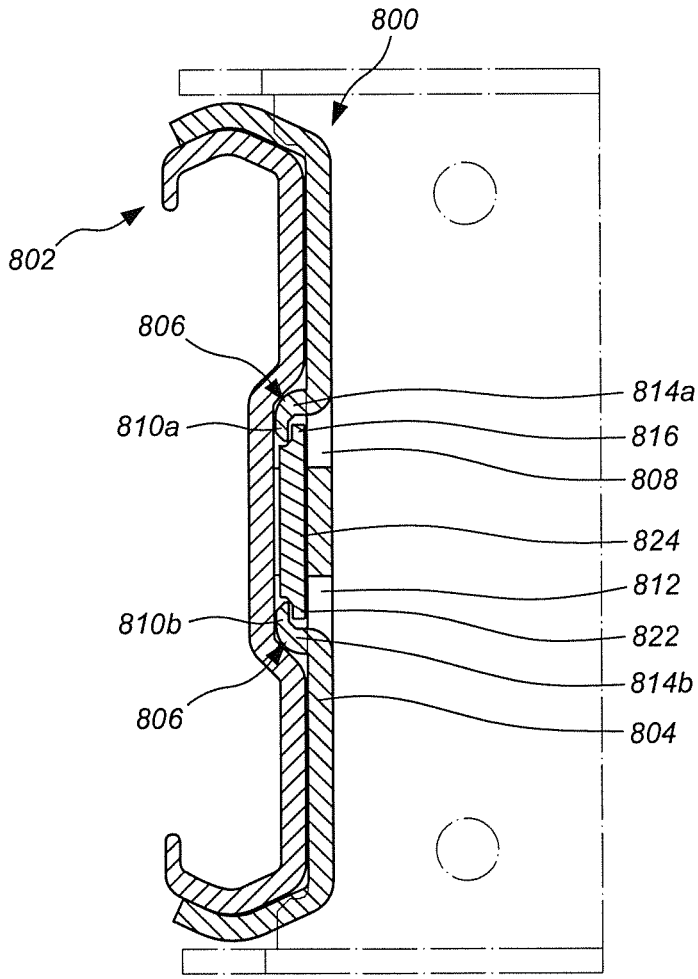
FIG. 10*b* shows the cross sectional view of the seventh embodiment between the bracket and the rail.

As shown in FIGS. 10*a* and 10*b*, the eighth embodiment comprises a bracket 800 and a rail 802 engaged with the bracket 800. The bracket 800 has a side portion 804. The side portion 804 of the bracket 800 has a first opening 808 located corresponding to the first connection portion 810*a* of the support member 806, and a second opening 812 located corresponding to the second connection portion 810*b* of the support member 806. A first bent section 814*a* is connected between the first connection portion 810*a* and the wall of the first opening 808. A second bent section 814*b* is connected between the second connection portion 810*b* and the wall of the second opening 812. A connection plate 824 is connected between the first and second protrusion 816, 822. The connection plate 824 is fixed to the recessed surface 820 of the reinforcement path 818. The first protrusion 816 is located away from the recessed surface 820 of the reinforcement path 818 and extends upward. The second protrusion 822 is located away from the recessed surface 820 of the reinforcement path 818 and extends downward. The first connection portion 810*a* extends downward from the first bent section 814*a* and the second connection portion 810*b* extends upward from the second bent section 814*b*. By the arrangement, the bracket 800 and the rail 802 can be movably connected to the reinforcement path 818 by the support member 806.

While we have shown and described the embodiment in accordance with the present invention, it should be clear to those skilled in the art that further embodiments may be made without departing from the scope of the present invention.

What is claimed is:

1. A combination of bracket and slide assembly, comprising:

a bracket having a top portion, a bottom portion located corresponding to the top portion, a side portion connected to the top and bottom portions, and a support member fixedly to the side portion, the top portion, the bottom portion and the side portion defining a longitudinal path, the support member located in the longitudinal path and having a first connection portion and a second connection portion, the first and second connection portions located away from the side portion; and a rail extending through the longitudinal path of the bracket and having a top wall, a bottom wall located corresponding to the top wall, and a sidewall connected to the top and the bottom walls, the sidewall having a reinforcement path with a recessed surface, the reinforcement path extending along a longitudinal direction of the rail and located corresponding to the support member of the bracket, a first protrusion and a second protrusion located on a top and a bottom of the reinforcement path;

wherein the top wall of the rail is engaged with the top portion of the bracket, the bottom wall of the rail is engaged with the bottom portion of the bracket, the sidewall of the rail is located corresponding to the side portion of the bracket, the first and second connection portions of the support member respectively contact the first and second protrusions and are located in the reinforcement path;

wherein the side portion of the bracket forms a rib which is located adjacent to the support member and the rib extends into the longitudinal path.

2. The combination as claimed in claim 1, wherein the first protrusion is connected to the sidewall of the rail and extends downward and into the reinforcement path, the second protrusion is connected to the sidewall of the rail and extends upward and into the reinforcement path.

3. The combination as claimed in claim 1, wherein the support member has an intermediate portion connected to the first and second connection portions, and multiple connection walls connected between the intermediate portion of the support member and the side portion of the bracket.

4. The combination as claimed in claim 1, wherein the support member has an intermediate portion connected to the first and second connection portions, the intermediate portion is fixed to the side portion of the bracket, the first connection portion has a first bent section which is located away from the side portion of the bracket, the second connection portion of the support member has a second bent section which is located corresponding to the first bent section.

5. The combination as claimed in claim 1, wherein the support member has an intermediate portion connected to the first and second connection portions, the side portion of the bracket forms a rib which is located corresponding to the intermediate portion of the support member, the intermediate portion is fixed to the rib.

6. The combination as claimed in claim 1, wherein the support member has an intermediate portion connected to the first and second connection portions, the side portion of the bracket has an opening located corresponding to the intermediate portion of the support member, the intermediate portion of the support member has a bent fixing section which extends through the opening and is connected to the side portion of the bracket.

7. The combination as claimed in claim 1, wherein the side portion of the support member has an opening, a first bent section is connected between the first connection portion of the support member and a wall of a first end of the opening, a second bent section is connected between the second connection portion and a wall of a second end of the opening, the second bent section is located corresponding to the first bent section.

8. The combination as claimed in claim 1, wherein the side portion of the support member has a first opening located corresponding to the first connection portion of the support member, a second opening located corresponding to the second connection portion of the support member, a first bent section is connected between the first connection portion and a wall of the first opening, a second bent section is connected between the second connection portion and a wall of the second opening, the first connection portion extends upward from the first bent section and the second connection portion extends downward from the second bent section.

9. The combination as claimed in claim 1, wherein the first protrusion is connected to the recessed surface of the reinforcement path and extends upward, the second protrusion is connected to the recessed surface of the reinforcement path and extends downward, the side portion of the bracket has a first opening which is located corresponding to the first connection portion of the support member and a second opening which is located corresponding to the second connection portion of the support member, a first bent section is connected between two respective walls of the first connection portion and the first opening, a second bent section is connected between two respective walls of the second connection portion and the second opening, the first connection portion extends downward from the first bent section and the second connection portion extends upward from the second bent section.

10. The combination as claimed in claim 1, wherein a connection plate is connected between the first and second protrusion, the connection plate is fixed to the recessed surface of the reinforcement path, the first protrusion is located away from the recessed surface of the reinforcement path and extends upward, the second protrusion is located away from the recessed surface of the reinforcement path and extends downward, the side portion of the bracket has a first opening located corresponding to the first connection portion of the support member, and a second opening located corresponding to the second connection portion of the support member, a first bent section is connected between the first connection portion and a wall of the first opening, a second bent section is connected between the second connection portion and a wall of the second opening, the first connection portion extends downward from the first bent section and the second connection portion extends upward from the second bent section.

* * * * *